US011828117B2

(12) United States Patent
Johnson et al.

(10) Patent No.: US 11,828,117 B2
(45) Date of Patent: Nov. 28, 2023

(54) HIGH-PRESSURE DRILLING ASSEMBLY

(71) Applicant: Schlumberger Technology Corporation, Sugar Land, TX (US)

(72) Inventors: Eric Johnson, Sugar Land, TX (US); Phillip Bailey, Katy, TX (US); Daniel Nobre, Neuquen (AR); Nalin Weerasinghe, Sagamihara (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 224 days.

(21) Appl. No.: 17/594,971

(22) PCT Filed: May 5, 2020

(86) PCT No.: PCT/US2020/031494

§ 371 (c)(1),
(2) Date: Nov. 4, 2021

(87) PCT Pub. No.: WO2020/227306

PCT Pub. Date: Nov. 12, 2020

(65) Prior Publication Data

US 2022/0316288 A1 Oct. 6, 2022

Related U.S. Application Data

(60) Provisional application No. 62/843,653, filed on May 6, 2019.

(51) Int. Cl.

| | |
|---|---|
| ***E21B 21/08*** | (2006.01) |
| ***E21B 4/02*** | (2006.01) |
| ***E21B 7/06*** | (2006.01) |

(52) U.S. Cl.

CPC ..... *E21B 21/08* (2013.01); *E21B 4/02* (2013.01); *E21B 7/06* (2013.01)

(58) Field of Classification Search

CPC ..... E21B 21/08; E21B 4/02; E21B 7/06
See application file for complete search history.

(56) References Cited

U.S. PATENT DOCUMENTS 4,241,796 A 12/1980 Green et al.
4,491,186 A * 1/1985 Alder ..... E21B 44/005 173/9

(Continued)

FOREIGN PATENT DOCUMENTS

WO 89011581 A1 11/1989
WO 2008136883 A1 11/2008
WO 2016137667 A1 9/2016

OTHER PUBLICATIONS

International Search Report and Written Opinion issued in International Patent application PCT/US2020/031494 dated Aug. 20, 2020, 12 pages.

(Continued)

*Primary Examiner* — Taras P Bemko
(74) *Attorney, Agent, or Firm* — Jeffrey D. Frantz

(57) ABSTRACT

A drilling assembly includes a hydraulic amplifier assembly, a driver, a bearing housing, and a shaft. The hydraulic amplifier assembly is configured to increase a pressure of a drilling fluid so as to produce a pressurized drilling fluid. The driver is driven by the pressure of the drilling fluid and is configured to rotate a drill bit. The bearing housing is coupled to the driver. The shaft extends through the bearing housing and is configured to be coupled to the drill bit. The shaft is driven to rotate by the driver. The hydraulic amplifier is configured to deliver the pressurized drilling fluid to the drill bit.

20 Claims, 5 Drawing Sheets

(56) References Cited

U.S. PATENT DOCUMENTS

| | | | | |
|---|---|---|---|---|
| 4,659,294 | A * | 4/1987 | Barthomeuf | F03C 1/0073 91/320 |
| 5,246,080 | A * | 9/1993 | Horvei | E21B 21/00 175/93 |
| 5,429,036 | A * | 7/1995 | Latos | E21B 7/18 91/181 |
| 5,984,026 | A * | 11/1999 | B.ae butted.kken | E21B 7/18 175/93 |
| 8,794,354 | B2 | 8/2014 | Xu et al. | |
| 8,827,009 | B1 | 9/2014 | Rankin, III | |
| 2001/0052427 | A1 | 12/2001 | Eppink et al. | |
| 2006/0073037 | A1* | 4/2006 | Pedersen | F15B 3/00 417/570 |
| 2007/0235227 | A1 | 10/2007 | Kirkhope et al. | |
| 2009/0107723 | A1* | 4/2009 | Kusko | E21B 1/00 175/25 |
| 2010/0130027 | A1 | 5/2010 | Sihler et al. | |
| 2010/0307830 | A1* | 12/2010 | Curlett | E21B 7/18 175/380 |
| 2015/0292265 | A1 | 10/2015 | Vail, III | |
| 2015/0337598 | A1* | 11/2015 | Rushton | E21B 10/62 175/57 |
| 2016/0326804 | A1* | 11/2016 | Gao | E21B 7/067 |
| 2021/0140239 | A1* | 5/2021 | Miess | E21B 4/02 |
| 2021/0301596 | A1* | 9/2021 | Schultz | E21B 21/08 |

OTHER PUBLICATIONS

International Preliminary Report on Patentability issued in International Patent application PCT/US2020/031494, dated Nov. 18, 2021, 6 pages.

Extended Search Report issued in European Patent Application No. 20801890.3 dated Nov. 11, 2022, 8 pages.

* cited by examiner

HIGH-PRESSURE DRILLING ASSEMBLY

CROSS-REFERENCE TO RELATED APPLICATIONS

This application is the U.S. national phase of International Patent Application No. PCT/US2020/031494, filed May 5, 2020, and entitled "High-pressure Drilling Assembly," which claims the benefit of, and priority to, U.S. Patent Application No. 62/843,653 filed on May 6, 2019, which is incorporated herein by this reference in its entirety.

BACKGROUND

Drill bits are used to bore holes into the earth in order to reach a fluid, e.g., hydrocarbon, reservoir. In a drilling assembly, the drill bit is positioned at the distal end of a drill string and rotated in order to advance into the rock formation. Drilling mud is typically circulated through the drill string and out through the drill bit to remove cuttings, maintain a desired pressure and temperature in the well, etc.

A mud motor can be used to produce rotation of the drill bit that is localized at the distal end of the drill string, which allows for the creation of non-vertical sections of a well. Mud motors typically rely on energy stored as pressure in the drilling mud, which the mud motors convert to mechanical rotational energy. Further, other devices are sometimes used instead of mud motors in the bottom hole assembly, such as turbines, agitators, rotary steerable systems (RSS), to provide additional or alternative functionality to rotating the drill bit without rotating the entire drill string above the device.

Some rock formations can be difficult to drill through and can cause rapid wear of the drill bit as a consequence.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the invention. The first object and the second object are both objects, respectively, but they are not to be considered the same object.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques and workflows that are in accordance with some embodiments. Some operations in the processing procedures, methods, techniques and workflows disclosed herein may be combined and/or the order of some operations may be changed.

Figure 1:
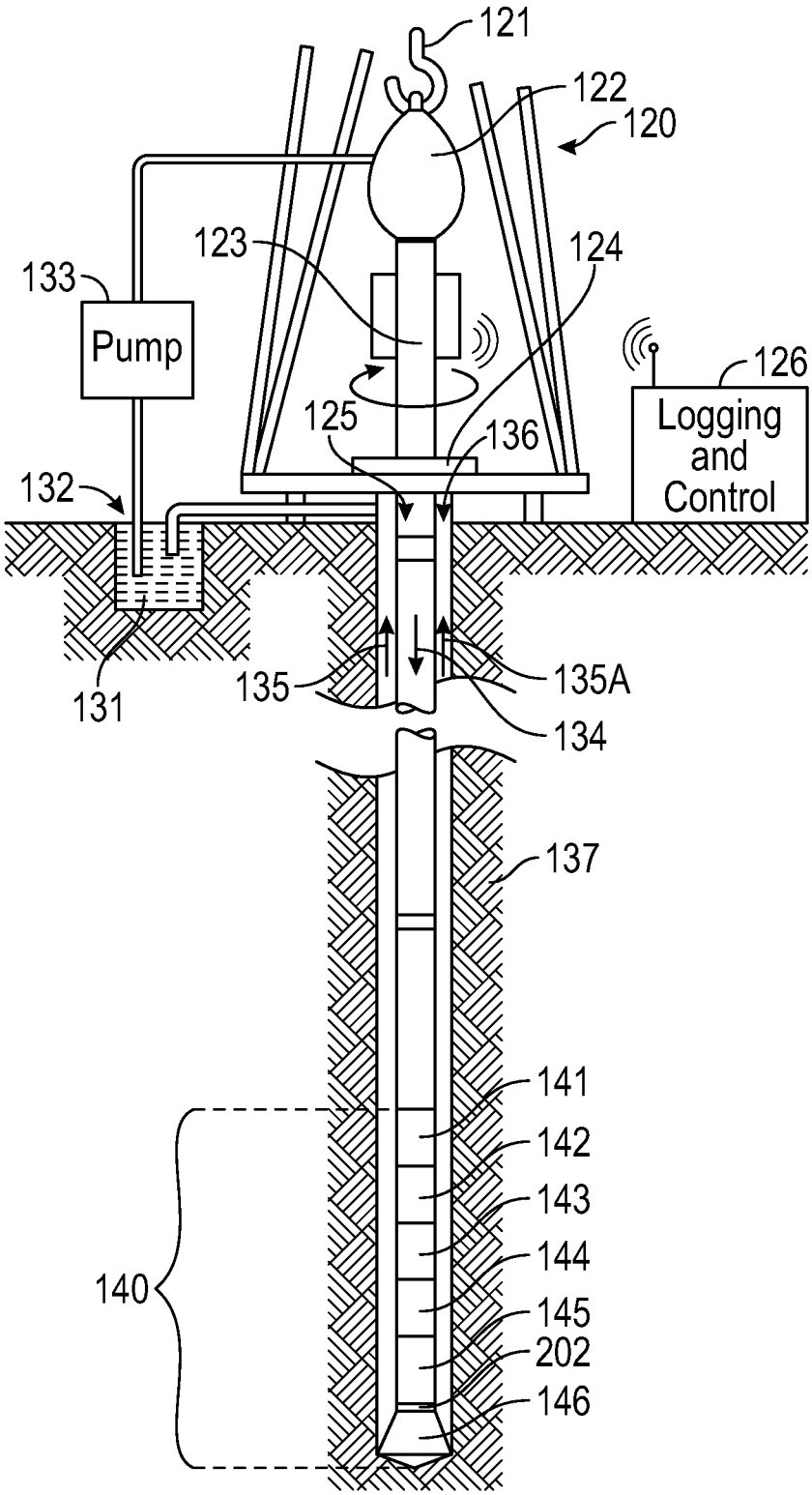
FIG. 1 illustrates a schematic view of an example of a wellsite system, according to an embodiment.

FIG. 1 illustrates a wellsite system according to an embodiment. The wellsite can be onshore or offshore. In this example system, a borehole is formed in subsurface formations by rotary drilling in a manner that is well known. A drill string 125 is suspended within a borehole 136 and has a bottom hole assembly (BHA) 140 which includes a drill bit 146 at its lower end. A surface system 120 includes platform and derrick assembly positioned over the borehole 136, the assembly including a rotary table 124, kelly (not shown), hook 121, and rotary swivel 122. The drill string 125 is rotated by the rotary table 124 energized by means not shown, which engages the kelly (not shown) at the upper end of the drill string 125. The drill string 125 is suspended from the hook 121, attached to a traveling block (also not shown), through the kelly (not shown) and the rotary swivel 122 which permits rotation of the drill string 125 relative to the hook 121. As is well known, a top drive system could be used instead of the rotary table system shown in FIG. 1.

In the illustrated example, the surface system further includes drilling fluid or mud 132 stored in a pit 131 formed at the well site. A pump 133 delivers the drilling fluid to the interior of the drill string 125 via a port (not shown) in the swivel 122, causing the drilling fluid to flow downwardly through the drill string 125 as indicated by the directional arrow 134. The drilling fluid exits the drill string via ports (not shown) in the drill bit 146, and then circulates upwardly through an annulus region 135 between the outside of the drill string 125 and the wall of the borehole 136, as indicated by the directional arrows 135 and 135A. In this manner, the drilling fluid lubricates the drill bit 146 and carries formation cuttings up to the surface as it is returned to the pit 131 for recirculation.

The BHA 140 of the illustrated embodiment may include a measuring-while-drilling (MWD) tool 141, a logging-while-drilling (LWD) tool 144, a rotary steerable directional drilling system 145 and motor, and the drill bit 146. It will also be understood that more than one LWD tool and/or MWD tool can be employed, e.g. as represented at 143. Furthermore, a mud motor may be provided in lieu of the rotary steerable drilling system 145.

The LWD tool 144 is housed in a special type of drill collar, as is known in the art, and can contain one or a plurality of known types of logging tools. The LWD tool 144 may include capabilities for measuring, processing, and storing information, as well as for communicating with the surface equipment. In the present example, the LWD tool 144 may any one or more well logging instruments known in the art, including, without limitation, electrical resistivity, acoustic velocity or slowness, neutron porosity, gamma-gamma density, neutron activation spectroscopy, nuclear magnetic resonance and natural gamma emission spectroscopy.

The MWD tool 141 is also housed in a special type of drill collar, as is known in the art, and can contain one or more devices for measuring characteristics of the drill string and drill bit. The MWD tool 141 further includes an apparatus 142 for generating electrical power to the downhole system. This may typically include a mud turbine generator powered by the flow of the drilling fluid, it being understood that other power and/or battery systems may be employed. In the present embodiment, the MWD tool 141 may include one or more of the following types of measuring devices: a weight-on-bit measuring device, a torque measuring device, a vibration measuring device, a shock measuring device, a stick slip measuring device, a direction measuring device, and an inclination measuring device. The power generating apparatus 142 may also include a drilling fluid flow modulator for communicating measurement and/or tool condition signals to the surface for detection and interpretation by a logging and control unit (e.g., a "controller") 126.

As discussed herein, the BHA 140 may have a hydraulic amplifier assembly 202. The hydraulic amplifier assembly 202 may be configured to increase a pressure of at least a portion of the drilling fluid that is received through the drill string and provided to the assembly 200. Although the hydraulic amplifier assembly 202 is illustrated in FIG. 1 as coupled to the drill bit 146, it is appreciated that the embodiments below describe various arrangements of the BHA 140 with the hydraulic amplifier assembly 202 in different positions within the BHA 140. The hydraulic amplifier assembly 202 increases the pressure of a portion of the drilling fluid downhole to pressures above about 650 bar, 2500 bar, 3500 bar, or 4500 bar, thereby reducing the components of the drill string that convey the pressurized drilling fluid to the drill bit. Through reducing the quantity of components and the length of lines conveying the pressurized drilling fluid to the drill bit, wear from the pressurized drilling fluid through the drill string may be reduced. Additionally, pressurizing a portion of the drilling fluid above a base pressure of the remainder may facilitate use of the remainder of the drilling fluid for other purposes (e.g., tool activation, hole cleaning) with reduced or eliminated modifications to other components of the BHA 140.

Figure 2:
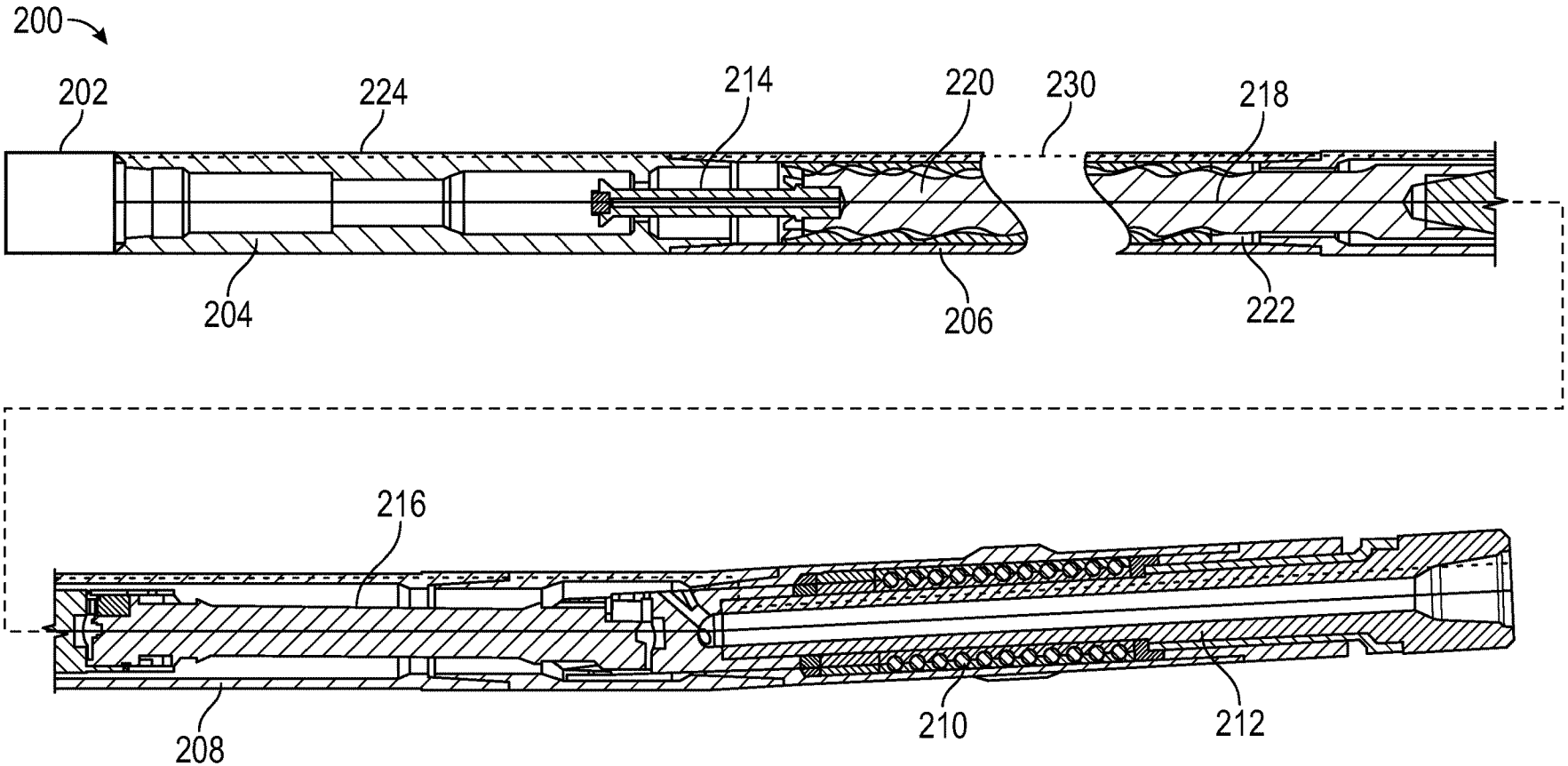
FIG. 2 illustrates a side, cross-sectional view of a high-pressure drilling assembly, according to an embodiment.

FIG. 2 illustrates a simplified, side, cross-sectional view of a high pressure drilling assembly 200, according to an embodiment. The assembly 200 may generally include a hydraulic amplifier assembly 202, a top sub 204, a driver 206, a transmission section 208, a bearing assembly 210, and a shaft 212. As shown, the hydraulic amplifier assembly 202 may be directly coupled to an uphole end of the top sub 204, which is in turn uphole of the driver 206, although this is merely one example of the position of this assembly 202 among many contemplated herein, and several other examples are described below.

The hydraulic amplifier assembly 202 may be configured to increase a pressure of a portion of the drilling fluid that is received through the drill string to the assembly 200. For example, the hydraulic amplifier assembly 202 may include a hydraulic-over-hydraulic, master-slave cylinders. As such, fluid pressure may be used to drive a relatively large, master cylinder, which may drive a relatively small, slave cylinder that increases the pressure in a portion of the drilling fluid. The pressurized drilling fluid is routed through the assembly 200 and delivered to a drill bit coupled to the downhole end of the shaft 212. The pressurized drilling fluid may be delivered at a pressure sufficient to water-jet cut a rock formation in which the drill bit is located. For example, the pressurized drilling fluid may be delivered at a pressure of from about 650 bar, about 1300 bar, about 2000 bar to about 2500 bar, about 3500 bar, or about 4500 bar.

The pressurized drilling fluid may be routed from the hydraulic amplifier assembly 202 through the remainder of the assembly 200, in one or more of several manners. For example, as indicated by lines in FIG. 2, the fluid may be routed through a line 218 (e.g., high pressure tubing or pipe) extending along the centerline of the top sub 204. In the illustrated embodiment, the driver 206 is a mud motor, but in other embodiments, the driver 206 may be a rotary steerable system (RSS), turbine, agitator, combinations thereof, etc. In the illustrated mud-motor embodiment, the driver 206 includes a rotor 220 and a stator 222. The rotor 220 is rotatable relative to the stator 222, as well as relative to the top sub 204, by converting pressure from the drilling fluid flowing therethrough into rotation. Accordingly, the line 218 may extend through the rotor 220, and may include a hydraulic coupling 214 to connect the portion of the line 218 in the stationary top sub 204 with the portion of the line 218 in the rotating rotor 220.

The line 218 may extend through a drive shaft 216 (e.g., including universal coupling(s)) of the transmission section 208, and through the shaft 212 extending through the bearing housing 210. The shaft 212 may be connected to the drill bit (not shown), and thus the line 218 may be configured to feed the drilling fluid that is pressurized in the hydraulic amplifier assembly 202 to the drill bit from within the shaft 212. In turn, the drill bit may include nozzles that direct the pressurized drilling fluid into the rock formation.

In another embodiment, as also depicted in FIG. 2, a line 230 may extend from the hydraulic amplifier assembly 202 through the remainder of the high-pressure drilling assembly 200. The line 230 may initially extend through the outer wall 224 of the top sub 204, and through the stator 222 of the driver 206. The line 230 may then turn radially inwards from an outer wall 226 of the transmission section 208, e.g., at the bearing housing 210, and proceed through an internal wall of the shaft 212. For example, a keyway slot may be formed in the outside surface of the top sub 204 and the driver 206, and a tubing or pipe positioned therein or a cover formed thereon to provide the conduit. In another embodiment, in the driver 206, the line 230 may extend through the rubber of the stator 222, be formed as a gunhole through the stator 222, or the like. Where the line 230 turns radially inwards at the bearing housing 210, the line 230 may, like the line 218, include a hydraulic coupling that allows the line 218 to extend from a relatively stationary structure (the stator 222) to a relatively rotating structure (the shaft 212).

Figure 3:
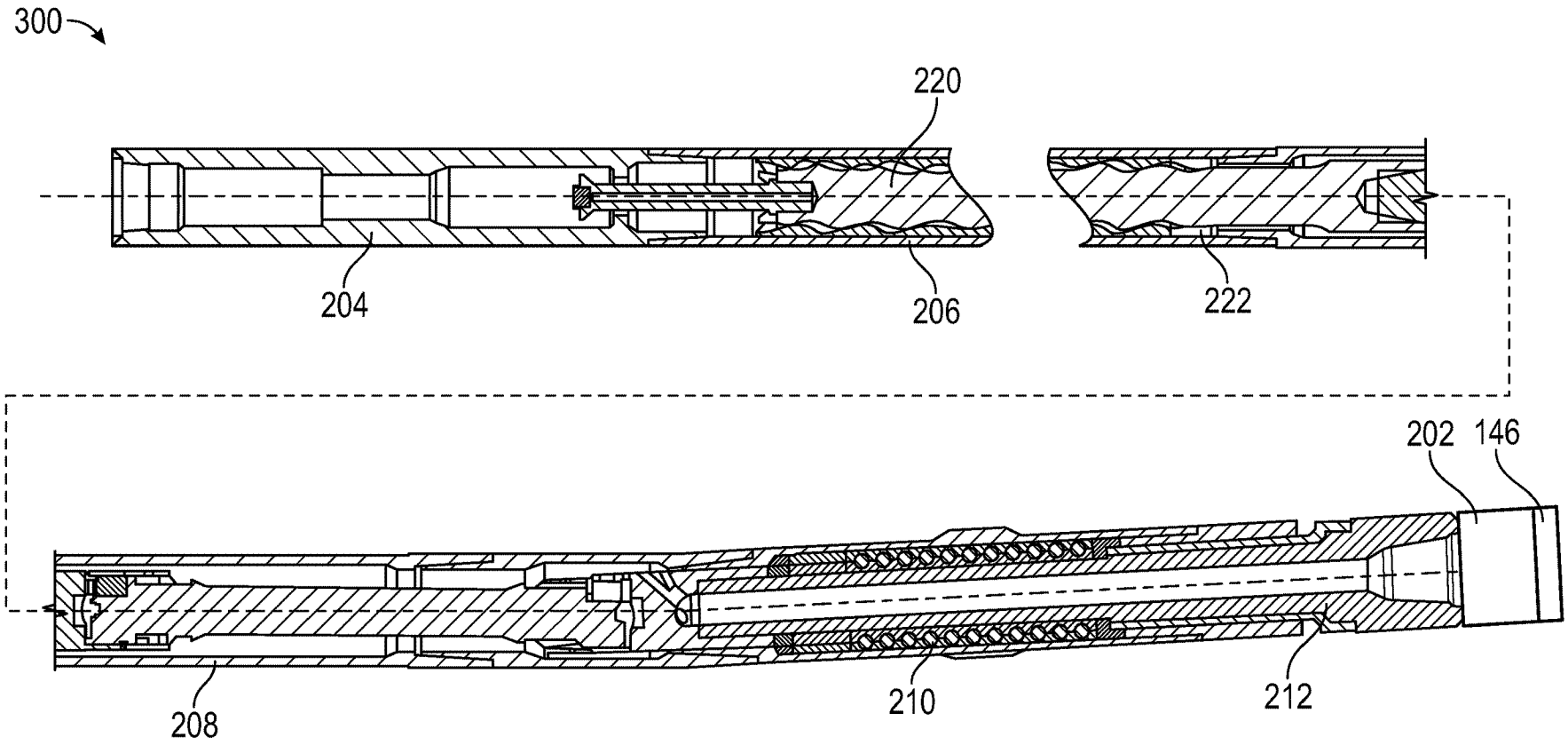
FIG. 3 illustrates a side, cross-sectional view of another high-pressure drilling assembly, according to an embodiment.

FIG. 3 illustrate a simplified, side, cross-sectional view of another high-pressure drilling assembly 300, according to an embodiment. The high-pressure drilling assembly 300 may be similar to the assembly 200, except that the hydraulic amplifier assembly 202 is positioned at the downhole end of the shaft 212, interposed between the shaft 212 and the drill bit. In some embodiments, the hydraulic amplifier assembly 202 is directly coupled to the drill bit 146. As such, the hydraulic amplifier assembly 202 may deliver pressurized drilling fluid directly to the drill bit, with the pressurized fluid line 218 and/or 230 being internal to the hydraulic amplifier assembly 202.

Figure 4:
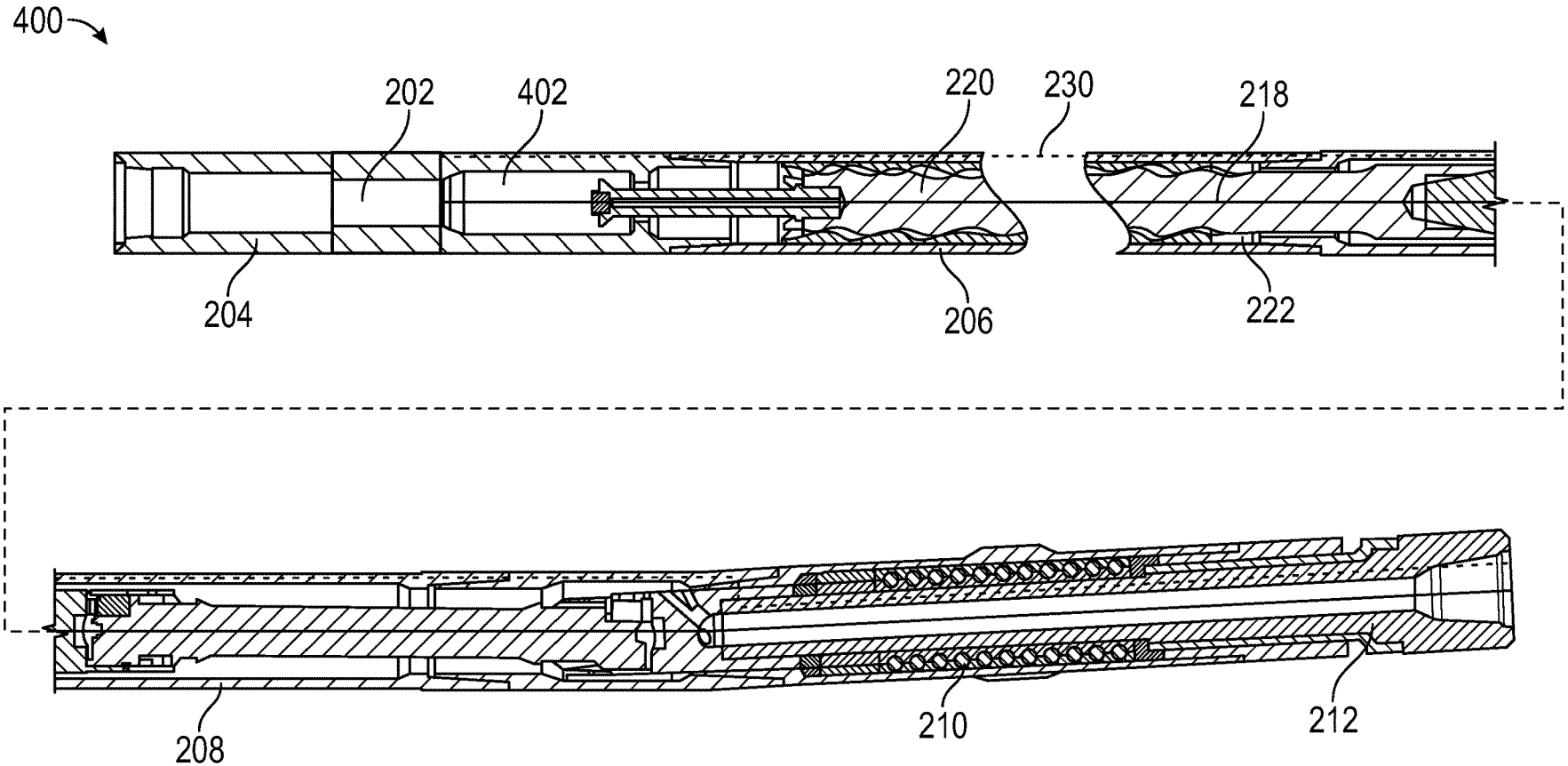
FIG. 4 illustrates a side, cross-sectional view of another high-pressure drilling assembly, according to an embodiment.

FIG. 4 illustrates a simplified, side, cross-sectional view of another high-pressure drilling assembly 400, according to an embodiment. The high-pressure drilling assembly 400 may be similar to the assembly 200, except that the hydraulic amplifier assembly 202 is not directly coupled to the uphole end of the top sub 204, but rather is integrated with the driver 206. The high-pressure drilling assembly 400 may include the line 218 or the line 230 in order to deliver pressurized fluid through a portion of the drilling assembly 400 to the drill bit. Accordingly, in this example, rather than directly converting pressure of a portion of drilling fluid into energy to pressurize another portion of the drilling fluid, the hydraulic amplifier assembly 202 may be powered mechanically via a shaft 402 connected to the rotor 220 of the driver 206. Thus, the rotor 220 rotating may be configured, in addition to rotating the drill bit, to drive the hydraulic amplifier assembly 202 to increase the pressure in the drilling fluid that is routed through line 218 or line 230. The line 218 may, for example, extend through the shaft 402. In another embodiment, the hydraulic amplifier assembly 202 may use pressure in a portion of the drilling fluid to increase the pressure of the drilling fluid delivered through the line 218 or 230, similar to the high-pressure drilling assembly 200 of FIG. 2.

Figure 5:
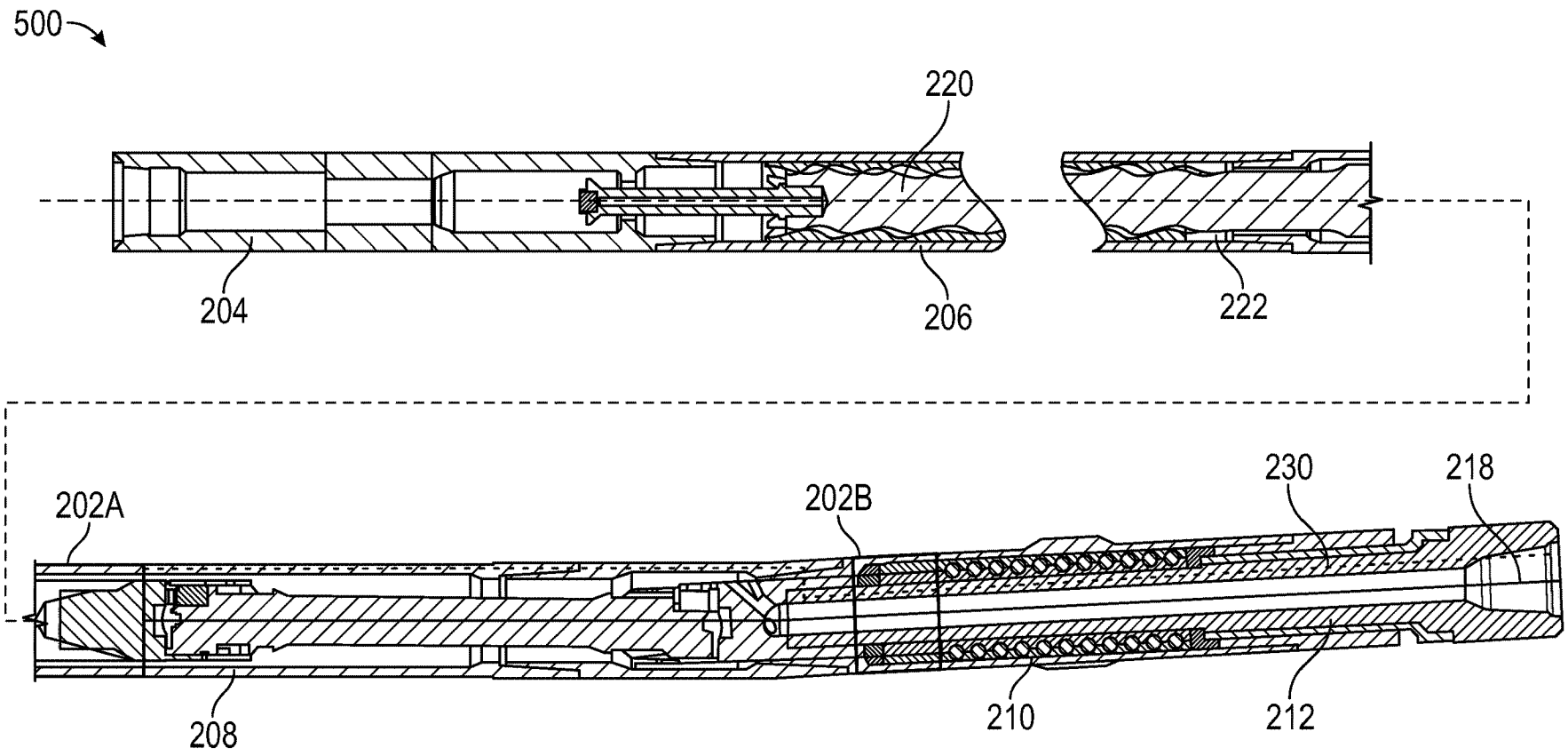
FIG. 5 illustrates a side, cross-sectional view of another high-pressure drilling assembly, according to an embodiment.

FIG. 5 illustrates a simplified, side, cross-sectional view of another high-pressure drilling assembly 500, according to an embodiment. The high-pressure drilling assembly 500 may be similar to the assembly 200, except that the hydraulic amplifier assembly 202 is not directly coupled to the uphole end of the top sub 204, but rather is integrated with the driver 206 and positioned downhole thereof. The assembly 500 may include the line 218 or the line 230 in order to deliver pressurized fluid through a portion of the drilling assembly 500 to the drill bit.

The hydraulic amplifier assembly 202 may be positioned in either of two general locations, as depicted and labeled as 202A, 202B, respectively. For example, the hydraulic amplifier assembly 202A may be positioned between the driver 206 and the transmission section 208, and/or the hydraulic amplifier assembly 202B may be positioned in or coupled to the bearing assembly 210. As both of these locations may be rotated by the driver 206, the hydraulic amplifier assembly 202 may operate using the rotational energy to pressurize the drilling fluid in the line 218 or 230, as mentioned above, or the drilling fluid in the line 218 or 230 may be pressurized using the pressure in the remaining drilling fluid. Furthermore, in the embodiment in which the hydraulic amplifier assembly 202 is located in the bearing housing 210, the lines 218 or 230 may omit hydraulic couplings, as the location of the hydraulic amplifier assembly 202 is in a rotating structure. Similarly, in an embodiment in which the hydraulic amplifier assembly 202 is between the transmission section 208 and the driver 206 and the line 218 is employed, the line 218 may likewise omit hydraulic couplings 214 shown in FIG. 2.

The foregoing description, for purpose of explanation, references specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be rearranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A drilling assembly, comprising:

a hydraulic amplifier assembly configured to increase a pressure of a drilling fluid so as to produce a pressurized drilling fluid;

a driver that is driven by the pressure of the drilling fluid and configured to rotate a drill bit;

a bearing housing coupled to the driver; and a shaft extending through the bearing housing and configured to be coupled to the drill bit, wherein the shaft is driven to rotate by the driver, wherein the hydraulic amplifier assembly is configured to deliver the pressurized drilling fluid to the drill bit, and wherein the hydraulic amplifier assembly is coupled to the driver, such that the driver is configured to drive the hydraulic amplifier assembly.

2. The drilling assembly of claim 1, wherein the hydraulic amplifier assembly is positioned uphole of the driver, the drilling assembly further comprising a line extending from the hydraulic amplifier assembly, through the driver, through the bearing housing, and through the shaft, wherein the line is configured to conduct the pressurized fluid from the hydraulic amplifier assembly to the drill bit.

3. The drilling assembly of claim 2, wherein the line extends along a centerline of the driver and through a rotor of the driver.

4. The drilling assembly of claim 2, wherein the line extends through a stator of the driver, radially inward to the shaft, and within the shaft.

5. The drilling assembly of claim 1, wherein the hydraulic amplifier assembly is positioned downhole of the driver.

6. The drilling assembly of claim 5, further comprising a transmission section extending between the driver and the shaft, wherein the hydraulic amplifier assembly is positioned between the driver and the transmission section.

7. The drilling assembly of claim 5, wherein the hydraulic amplifier assembly is coupled to the bearing housing.

8. The drilling assembly of claim 1, wherein the pressurized drilling fluid is delivered to the drill bit above 650 bar.

9. The drilling assembly of claim 1, wherein the pressurized drilling fluid is delivered to the drill bit above 2500 bar.

10. A method of delivering a pressurized drilling fluid to a drill bit comprising:

directing a drilling fluid through a driver configured to rotate a shaft;

rotating the drill bit coupled to the shaft;

providing a portion of the drilling fluid to a hydraulic amplifier assembly configured to increase a pressure of the portion of the drilling fluid above 650 bar;

driving the hydraulic amplifier assembly via the driver; and delivering the pressurized drilling fluid to the drill bit.

11. The method of claim 10, wherein delivering the pressurized drilling fluid to the drill bit comprises routing the pressurized drilling fluid through the driver.

12. The method of claim 11, wherein delivering the pressurized drilling fluid to the drill bit further comprises routing the pressurized drilling fluid through the shaft.

13. The method of claim 10, wherein the hydraulic amplifier assembly is positioned downhole of the driver.

14. The method of claim 10, wherein the hydraulic amplifier assembly is positioned uphole of the driver.

15. The method of claim 10, wherein the driver includes a rotor and a stator.

16. A method of delivering a pressurized drilling fluid to a drill bit comprising:

directing a drilling fluid through a driver configured to rotate a shaft;

rotating the drill bit coupled to the shaft;

providing a portion of the drilling fluid to a hydraulic amplifier assembly configured to increase a pressure of the portion of the drilling fluid above 650 bar; and delivering the pressurized drilling fluid to the drill bit, wherein delivering the pressurized drilling fluid to the drill bit comprises routing the pressurized drilling fluid through the driver.

17. The method of claim 16, wherein the hydraulic amplifier assembly is positioned downhole of the driver.

18. The method of claim 16, wherein the hydraulic amplifier assembly is positioned uphole of the driver.

19. The method of claim 16, wherein delivering the pressurized drilling fluid to the drill bit further comprises routing the pressurized drilling fluid through the shaft.

20. The method of claim 16, wherein the hydraulic amplifier assembly is coupled to the drill bit.

* * * * *